US012571081B2

(12) United States Patent
Lee et al.

(10) Patent No.: US 12,571,081 B2
(45) Date of Patent: Mar. 10, 2026

(54) NON-ORIENTED ELECTRICAL STEEL SHEET HAVING SUPERIOR MAGNETIC PROPERTIES AND METHOD OF MANUFACTURING SAME

(71) Applicant: POSCO, Pohang-si (KR)

(72) Inventors: Hun Ju Lee, Pohang-si (KR); Yong-Soo Kim, Pohang-si (KR); Su-Yong Shin, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 823 days.

(21) Appl. No.: 17/298,129

(22) PCT Filed: Nov. 8, 2019

(86) PCT No.: PCT/KR2019/015193
§ 371 (c)(1),
(2) Date: May 28, 2021

(87) PCT Pub. No.: WO2020/111570
PCT Pub. Date: Jun. 4, 2020

(65) Prior Publication Data

US 2022/0018002 A1 Jan. 20, 2022

(30) Foreign Application Priority Data

Nov. 30, 2018 (KR) ..... 10-2018-0152973

(51) Int. Cl.

| | |
|---|---|
| ***C22C 38/06*** | (2006.01) |
| ***C21D 8/02*** | (2006.01) |
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/24*** | (2006.01) |
| ***C22C 38/26*** | (2006.01) |

(52) U.S. Cl.
CPC ..... *C22C 38/06* (2013.01); *C21D 8/0205* (2013.01); *C21D 8/0226* (2013.01); *C21D 9/46* (2013.01); *C22C 38/001* (2013.01); *C22C 38/002* (2013.01); *C22C 38/02* (2013.01); *C22C 38/04* (2013.01); *C22C 38/24* (2013.01); *C22C 38/26* (2013.01)

(58) Field of Classification Search
CPC ..... C22C 38/06; C22C 38/001; C22C 38/002; C22C 38/02; C22C 38/04; C22C 38/24; C22C 38/26; C22C 38/004; C22C 38/12; C21D 8/0205; C21D 8/0226; C21D 9/46; C21D 6/005; C21D 6/008; C21D 8/12; C21D 8/1222; C21D 8/1233; C21D 8/1261; C21D 8/1272; H01F 1/147
See application file for complete search history.

(56) References Cited

U.S. PATENT DOCUMENTS

| | | | | |
|---|---|---|---|---|
| 6,322,639 | B1 * | 11/2001 | Matsuzaki | C21D 8/1222 148/306 |
| 2013/0167987 | A1 | 7/2013 | Kim et al. | |
| 2016/0273064 | A1 * | 9/2016 | Kataoka | C22C 38/001 |
| 2017/0044641 | A1 * | 2/2017 | Fortunati | C22C 38/004 |
| 2017/0362677 | A1 | 12/2017 | Kim et al. | |

FOREIGN PATENT DOCUMENTS

| | | | | |
|---|---|---|---|---|
| CN | 101218362 | A | 7/2008 | |
| EP | 3239326 | A1 * | 11/2017 | C21D 6/008 |
| JP | H07-150248 | A | 6/1995 | |
| JP | H08-269532 | A | 10/1996 | |
| JP | 2000-104144 | A | 4/2000 | |
| JP | 2007-031793 | A | 2/2007 | |
| JP | 4126479 | B2 | 7/2008 | |
| JP | 2010-150667 | A | 7/2010 | |
| JP | 2012-036454 | A | 2/2012 | |
| JP | 5713100 | B2 | 5/2015 | |
| JP | 2016156044 | A * | 9/2016 | |
| JP | 2017-036491 | A | 2/2017 | |
| JP | 2018-021242 | A | 2/2018 | |
| JP | 2018-508646 | A | 3/2018 | |
| JP | 2018178197 | A * | 11/2018 | |
| KR | 10-2015-0119433 | A | 10/2015 | |
| KR | 10-1703071 | B1 | 2/2017 | |
| KR | 10-2018-0070951 | A | 6/2018 | |
| KR | 10-1904309 | B1 | 10/2018 | |
| WO | 2017/111549 | A1 | 6/2017 | |
| WO | 2018/179871 | A1 | 10/2018 | |

OTHER PUBLICATIONS

International Search Report (with partial translation) and Written Opinion dated Feb. 26, 2020, issued in corresponding International Patent Application No. PCT/KR2019/015193.
Chinese Office Action dated Apr. 25, 2022 issued in Chinese Patent Application No. 201980079240.6.
Extended European Search Report dated Aug. 23, 2021 issued in European Patent Application No. 19888950.3.

* cited by examiner

*Primary Examiner* — Christina A Johnson
(74) *Attorney, Agent, or Firm* — Morgan Lewis & Bockius LLP

(57) ABSTRACT

A non-oriented electrical steel sheet with excellent magnetism may include Si at 2.5 to 3.8 wt %, Al at 0.5 to 2.5 wt %, Mn at 0.2 to 4.5 wt %, C at 0.005 wt % or less (excluding 0 wt %), S at 0.005 wt % or less (excluding 0 wt %), N at 0.005 wt % or less (excluding 0 wt %), Nb at 0.004% or less (excluding 0 wt %), Ta at 0.0005 to 0.0025 wt %, and the balance of Fe and inevitable impurities.

5 Claims, No Drawings

NON-ORIENTED ELECTRICAL STEEL SHEET HAVING SUPERIOR MAGNETIC PROPERTIES AND METHOD OF MANUFACTURING SAME

CROSS-REFERENCE OF RELATED APPLICATIONS

This application is the U.S. National Phase under 35 U.S.C. § 371 of International Application No. PCT/KR2019/015193 filed on Nov. 8, 2019, which claims the benefit of Korean Application No. 10-2018-0152973 filed on Nov. 30, 2018, the entire contents of each are hereby incorporated by reference.

TECHNICAL FIELD

Background Art

(a) Field of the Invention

The present invention relates to a non-oriented electrical steel sheet and a manufacturing method thereof. More specifically, the present invention relates to a non-oriented electrical steel sheet that is used as an iron core material of rotation devices such as motors and generators, and a manufacturing method thereof, and to a non-oriented electrical steel sheet having an excellent magnetic characteristic and a manufacturing method thereof.

(b) Description of the Related Art

A non-oriented electrical steel sheet is mainly used in a motor that convert electrical energy to mechanical energy, and an excellent magnetic characteristic of the non-directional electrical steel sheet is required to achieve high efficiency while the motor converts the electrical energy to the mechanical energy. Recently, as environmentally-friendly technology has been highlighted, it is very important to increase efficiency of the motor using about half of the total electrical energy, and thus demand for non-directional electrical steel with an excellent magnetic characteristic also increases. The magnetic characteristic of the non-oriented electrical steel is mainly evaluated by iron loss and magnetic flux density. The iron loss means energy loss occurring at a specific magnetic flux density and frequency, and the magnetic flux density means a degree of magnetization obtained in a specific magnetic field. As the core loss decreases, a more energy efficient motor may be manufactured in the same conditions, and as the magnetic flux density is higher, it is possible to downsize the motor and to reduce copper loss, thus it is important to manufacture the non-directional electric steel sheet having low iron loss and high magnetic flux density. Depending on operational conditions of the motor, the characteristic of the non-oriented electrical steel sheet that should be considered is also varied. As a reference for determining the characteristic of the non-oriented electrical steel sheet used in the motor, many motors regard $W_{15/50}$, which is iron loss when a magnetic field of 1.5 T is applied at a commercial frequency of 50 Hz, as the most important value. However, all motors used for various purposes do not value the iron loss of $W_{15/50}$ as the most important, and they also estimate iron loss at other frequencies or applied magnetic fields according to a main operational condition. Particularly, in the non-oriented electrical steel sheet having a thickness of 0.35 mm or less that is recently used in a motor for driving an electric car, there are many cases in which the magnetic characteristic is important in a low magnetic field of 1.0 T or less and a high frequency of 400 Hz or more, so the characteristic of the non-oriented electrical steel sheet is estimated with an iron loss such as $W_{10/400}$. A typically used method for increasing the magnetic properties of the non-oriented electrical steel sheet is to add an alloying element such as Si. The addition of the alloying element can increase specific resistance of the steel, and as the specific resistance is higher, eddy current loss decreases, thereby reducing the total iron loss. On the contrary, as the content of Si increases, the magnetic flux density is deteriorated and brittleness increases, and when more than a predetermined amount thereof is added, it may not be cold-rolled and may not be able to be commercially produced. Particularly, the electrical steel sheet may obtain the effect of reducing the iron loss as it becomes thinner, but the deterioration of rolling by the brittleness is a serious problem. A maximum content of Si that may be commercially produced is known to be about 3.5 to 4.0%, and elements such as Al and Mn may be added to additionally increase the specific resistance of the steel to produce the finest non-oriented electrical steel sheet having excellent magnetism. The iron loss may be classified into three types: hysteresis loss, classical eddy current loss, and anomalous eddy current loss. In this case, an effect that may be obtained by increasing the specific resistance of the steel is reduction of the eddy current loss, and it is known that the effect of reducing the iron loss significantly decreases when the specific resistance is increased to 65μ·Ω·cm or more. Therefore, it is important to reduce the hysteresis loss in order to reduce the iron loss in a high specific resistance component system. A method of reducing the hysteresis loss include a method of suppressing influence of precipitates and non-metallic inclusions that may interfere with movement of a magnetic domain wall, a method of lowering residual stress, or a method of growing a magnetically advantageous texture. A method of reducing the iron loss of the non-oriented electrical steel sheets by controlling precipitates or non-metallic inclusions has been continuously developed from the past. As one of the prior art techniques, there is a technique of obtaining low iron loss by reducing a content of Al in steel to suppress precipitation of fine AlN. In addition, as another of the prior art techniques, there is a technique of obtaining low iron loss by controlling a composition of inclusions formed from a composite oxide of Si, Al, and Mn in addition to a low content of Al. However, these methods are difficult to implement in practice, or provide an effect only under very limited conditions, and there is a limit to an effect of reducing iron loss due to a lack of understanding of a size of the precipitate that deteriorates actual magnetism.

DISCLOSURE

Description of the Drawings

The present invention has been made in an effort to provide a non-oriented electrical steel sheet and a manufacturing method thereof. More specifically, the present invention has been made in an effort to provide a non-oriented electrical steel sheet that is used as an iron core material of rotation devices such as motors and generators, and a manufacturing method thereof, and to provide a non-oriented electrical steel sheet having an excellent magnetic characteristic and a manufacturing method thereof.

A non-oriented electrical steel sheet according to an embodiment of the present invention includes Si at 2.5 to 3.8 wt %, Al at 0.5 to 2.5 wt %, Mn at 0.2 to 4.5 wt %, C at 0.005 wt % or less (excluding 0 wt %), S at 0.005 wt % or less (excluding 0 wt %), N at 0.005 wt % or less (excluding 0 wt %), Nb at 0.004% or less (excluding 0 wt %), Ti at 0.004% or less (excluding 0 wt %), V at 0.004% or less (excluding 0 wt %), Ta at 0.0005 to 0.0025 wt %, and the balance of Fe and inevitable impurities.

The steel sheet may further include one or more of Cu at 0.025 wt % or less (excluding 0 wt %), B at 0.002 wt % or less (excluding 0 wt %), Mg at 0.005 wt % or less (excluding 0 wt %), and Zr at 0.005 wt % or less (excluding 0 wt %). The steel sheet may include one or more of a carbide-based precipitate, a nitride-based precipitate, and a sulfide-based precipitate having a diameter of 20 to 100 nm, and a distribution density of each of the carbide-based precipitate, the nitride-based precipitate, and the sulfide-based precipitate may be 0.9 pcs/$\mu m^2$ or less. More specifically, the distribution density may be 0.5 pcs/$\mu m^2$ or less.

A thickness of the steel sheet may be 0.1 to 0.3 mm.

An average grain diameter of the steel sheet may be 40 to 100 μm.

In the steel sheet, a hysteresis loss in $W_{15/50}$ iron loss may be 1.0 W/kg or less, and a hysteresis loss in $W_{10/400}$ iron loss may be 3.8 W/kg or less.

A manufacturing method of a non-oriented electrical steel sheet according to an embodiment of the present invention includes: preparing a slab containing Si at 2.5 to 3.8 wt %, Al at 0.5 to 2.5 wt %, Mn at 0.2 to 4.5 wt %, C at 0.005 wt % or less (excluding 0 wt %), S at 0.005 wt % or less (excluding 0 wt %), N at 0.005 wt % or less (excluding 0 wt %), Nb at 0.004 wt % or less (excluding 0 wt %), Ti at 0.004 wt % or less (excluding 0 wt %), V at 0.004 wt % or less (excluding 0 wt %), Ta at 0.0005 to 0.0025 wt %, and the balance of Fe and inevitable impurities; heating the slab; hot-rolling the heated slab to manufacture a hot-rolled sheet; cold-rolling the hot-rolled sheet to manufacture a cold-rolled sheet; and final annealing the cold-rolled sheet to manufacture an electrical steel sheet.

The slab may includes may further include one or more of Cu at 0.025 wt % or less (excluding 0 wt %), B at 0.002 wt % or less (excluding 0 wt %), Mg at 0.005 wt % or less (excluding 0 wt %), and Zr at 0.005 wt % or less (excluding 0 wt %).

The steel sheet may include one or more of a carbide-based precipitate, a nitride-based precipitate, or a sulfide-based precipitate having a diameter of 20 to 100 nm, and a distribution density of each of the carbide-based precipitate, the nitride-based precipitate, and the sulfide-based precipitate may be 0.9 pcs/$\mu m^2$ or less. More specifically, the distribution density may be 0.5 pcs/$\mu m^2$ or less.

After the manufacturing of the hot-rolled sheet, hot-rolled-sheet-annealing the hot-rolled sheet may be further included.

According to the embodiment of the present invention, by limiting contents of Si, Al, and Mn so as to have sufficiently high specific resistance, and by presenting an optimum content range of Ta while limiting contents of C, N, S, Nb, Ti, and V to suppress formation of carbide-based precipitates, nitride-based precipitates, or sulfide-based precipitates having a diameter of 20 to 100 nm that are undesirable for magnetism, it is possible to provide a non-oriented electrical steel sheet having excellent magnetism with low hysteresis loss.

Therefore, it is possible to improve efficiency of motors and generators that use the finest non-oriented electrical steel sheet having excellent magnetism with low hysteresis loss.

MODE FOR INVENTION

In the present specification, it will be understood that, although the terms first, second, third, etc. may be used herein to describe various elements, components, regions, areas, layers, and/or sections, they are not limited thereto. These terms are only used to distinguish one element, component, region, layer, or section from another element, component, region, layer, or section.

Therefore, a first part, component, area, layer, or section to be described below may be referred to as second part, component, area, layer, or section within the range of the present invention.

In the present specification, unless explicitly described to the contrary, the word "comprise" and variations such as "comprises" or "comprising" will be understood to imply the inclusion of stated elements but not the exclusion of any other elements.

The technical terms used herein are to simply mention a particular embodiment and are not meant to limit the present invention. An expression used in the singular encompasses an expression of the plural, unless it has a clearly different meaning in the context. In the specification, it is to be understood that the terms such as "including", "having", etc., are intended to indicate the existence of specific features, regions, numbers, stages, operations, elements, components, and/or combinations thereof disclosed in the specification, and are not intended to preclude the possibility that one or more other features, regions, numbers, stages, operations, elements, components, and/or combinations thereof may exist or may be added.

In the present specification, the term "combination of these" included in the expression of a Markush form means one or more mixtures or combinations selected from a group consisting of configuration components described in the Markush form representation, and it means to include one or more selected from the group consisting of the configuration components.

In the present specification, when referring to a part as being "on" or "above" another part, it may be positioned directly on or above another part, or another part may be interposed therebetween. In contrast, when referring to a part being "directly above" another part, no other part is interposed therebetween.

Unless otherwise defined, all terms used herein, including technical or scientific terms, have the same meanings as those generally understood by those with ordinary knowledge in the field of art to which the present invention belongs. Terms defined in commonly used dictionaries are further interpreted as having meanings consistent with the relevant technical literature and the present disclosure, and are not to be construed as having idealized or very formal meanings unless defined otherwise.

Unless mentioned in a predetermined way, % represents wt %, and 1 ppm is 0.0001 wt %.

In embodiments of the present invention, inclusion of an additional element means replacing the remaining iron (Fe) by an additional amount of the additional elements.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

In the non-oriented electrical steel sheet, carbide-based precipitates, nitride-based precipitates, or sulfide-based precipitates having a diameter of 20 to 100 nm hinder movement of the magnetic domain wall, thereby deteriorating magnetic characteristics of the electrical steel sheet. On the other hand, by adding an appropriate amount of Ta in addition to various components contained in steel, formation of precipitates having a diameter of 20 to 100 nm may be suppressed. Therefore, it should be noted that as a result, a non-oriented electrical steel sheet having excellent magnetic characteristics may be manufactured.

First, a non-oriented electrical steel sheet according to an embodiment of the present invention includes Si at 2.5 to 3.8 wt %, Al at 0.5 to 2.5 wt %, Mn at 0.2 to 4.5 wt %, C at 0.005 wt % or less (excluding 0 wt %), S at 0.005 wt % or less (excluding 0 wt %), N at 0.005 wt % or less (excluding 0 wt %), Nb at 0.004% or less (excluding 0 wt %), Ti at 0.004% or less (excluding 0 wt %), V at 0.004% or less (excluding 0 wt %), Ta at 0.0005 to 0.0025 wt %, and the balance of Fe and inevitable impurities.

More specifically, the non-oriented electrical steel sheet may further include: one or more of Cu at 0.025 wt % or less (excluding 0 wt %), B at 0.002 wt % or less (excluding 0 wt %), Mg at 0.005 wt % or less (excluding 0 wt %), and Zr at 0.005 wt % or less (excluding 0 wt %).

More specifically, the steel sheet may include one or more of a carbide-based precipitate, a nitride-based precipitate, and a sulfide-based precipitate having a diameter of 20 to 100 nm, and a distribution density of each of the carbide-based precipitate, the nitride-based precipitate, and the sulfide-based precipitate may be 0.9 pcs/$\mu m^2$ or less. More specifically, the distribution density is 0.5 pcs/$\mu m^2$ or less.

First, the reason for limiting the components of the non-oriented electrical steel sheet will be described.

Si at 2.5 to 3.8 wt %

Si serves to reduce iron loss by increasing specific resistance of a material, and when too little is added, an effect of improving high frequency iron loss may be insufficient. Conversely, when too much is added, brittleness of the material increases, and a cold-rolling characteristic is extremely deteriorated, so that productivity and punching characteristics may be rapidly deteriorated. Therefore, Si may be added in the above-mentioned range. Specifically, Si may be contained in an amount of 2.7 to 3.7 wt %. More specifically, Si may be contained in an amount of 3.0 to 3.6 wt %.

Al at 0.5 to 2.5 wt %.

Al serves to increase the specific resistance of the material to lower the iron loss, and when too little Al is added, since a fine nitride is formed, it may be difficult to obtain a magnetism improvement effect. Conversely, when too much is added, the nitride is excessively formed, deteriorating the magnetism, and causing problems in all processes such as steel making and continuous casting, which may considerably reduce productivity. Therefore, Al may be added in the above-mentioned range. Specifically, Al may be contained in an amount of 0.5 to 2.3 wt %. More specifically, Al may be contained in an amount of 0.7 to 2.0 wt %.

Mn at 0.2 to 4.5 wt %

Mn serves to increase the specific resistance of the material to improve the iron loss and to form a sulfide, and when too little Mn is added, the sulfide may be finely formed to cause magnetism deterioration. Conversely, when too much is added, MnS is excessively precipitated, and formation of a {111} texture unfavorable to magnetism is promoted, so that the magnetic flux density may rapidly decrease. Therefore, Mn may be added in the above-mentioned range. Specifically, Mn may be contained in an amount of 0.3 to 4.0 wt %. More specifically, Mn may be contained in an amount of 0.7 to 2.0 wt %.

C at 0.005 wt % or Less (Excluding 0 wt %)

Since C causes magnetic aging and combines with other impurity elements to form carbides to reduce magnetic characteristics, the smaller it is, the more preferable it is, and more specifically, it may be managed at 0.003 wt % or less.

N at 0.005 wt % or Less (Excluding 0 wt %)

Since N not only forms fine and long AlN precipitates inside a base material, but also forms fine nitrides by bonding with other impurities such that it suppresses grain growth to deteriorates iron loss, the smaller it is, the more preferable it is, and more specifically, it may be managed at 0.003 wt % or less.

S at 0.005 wt % or Less (Excluding 0 wt %)

Since S forms MnS and CuS, which are fine precipitates, to deteriorate magnetic characteristics and deteriorate hot workability, it is good to be maintained small, but since it is an element that is indispensably present in the steel, more specifically, it should be controlled at 0.003 wt % or less.

Nb, Ti, or V at 0.004 wt % or Less (Excluding 0 wt %)

Nb, Ti, and V are elements that have a very strong tendency to form precipitates in the steel, and form fine carbides, nitrides, or sulfides inside the base metal to inhibit crystal grain growth, thereby deteriorating iron loss. Particularly, carbon, nitride, and sulfide-based precipitates containing Nb, Ti, and V having a diameter of 20 to 100 nm significantly degrade magnetism, and when respective contents of Nb, Ti, and V exceeds 0.004 wt %, formation of precipitates with a diameter of 20 to 100 nm is promoted. Therefore, the contents of Nb, Ti, and V should be managed to be 0.004 wt % or less, and more specifically, 0.002 wt % or less. In this case, the diameter of the precipitate means a diameter of an imaginary circle having the same area as an area occupied by the precipitate.

Ta at 0.0005 to 0.0025 wt %

Ta is known as an element that forms carbides when added in a small amount in the steel, and generally, it forms complex carbides together with Nb, Ti, and V. When the content of Ta in the steel is 0.0005 to 0.0025 wt %, since it coarsens a size of the carbide to 100 nm or more, it suppresses formation of carbides having a diameter of 20 to 100 nm, which are not desirable for magnetism. In addition, it suppresses formation of nitrides and sulfides having a size of 20 to 100 nm. When the content of Ta is too high, the fraction of precipitates having a size of 20 to 100 nm increases, which is undesirable for magnetism, and conversely, when it is too low, the formation of precipitates of 20 to 100 nm may not be suppressed.

Other Impurity Elements

In addition to the above elements, impurities such as Cu, B, Mg, and Zr may be inevitably contained. Although these elements are contained in trace amounts, since they may cause magnetism deterioration due to formation of inclusions in the steel, Cu should be managed at 0.025 wt % or less (excluding 0 wt %), B should be managed at 0.002 wt % or less (excluding 0 wt %), Mg should be managed at 0.005 wt % or less (excluding 0 wt %), and Zr should be managed at 0.005 wt % or less (excluding 0 wt %).

In addition to the above components, the present invention includes Fe and inevitable impurities. Since the inevitable impurities are widely known in the art, a detailed description thereof will be omitted. In the embodiment of the present invention, the addition of effective elements other than the above elements is not excluded.

In the non-oriented electrical steel sheet according to the embodiment of the present invention, a thickness of the steel sheet may be 0.1 to 0.3 mm. In addition, an average grain diameter may be 40 to 100 μm.

In the non-direction electrical steel sheet according to the embodiment of the present invention, hysteresis loss is 1.0 W/kg or less in $W_{15150}$ iron loss, and hysteresis loss is 3.8 W/kg or less in $W_{10/400}$ iron loss. Specifically, the hysteresis loss may be 1.0 W/kg or less in $W_{15150}$ iron loss, and the hysteresis loss may be 3.8 W/kg or less in $W_{10/400}$ iron loss.

In the non-oriented electrical steel sheet according to the embodiment of the present invention, a magnetic flux density ($B_{50}$) may be 1.63 T or more in a steel sheet thickness of 0.1 μm, 1.65 T or more in a steel sheet thickness of 0.15 μm, 1.67 T or more in a steel sheet thickness of 0.25 μm, 1.67 T or more in a steel sheet thickness of 0.27 μm, and 1.68 T or more in a steel sheet thickness of 0.3 μm. The magnetic flux density is a value that decreases as the thickness decreases, and when a material with the high magnetic flux density is used in a motor for a vehicle, excellent torque may be obtained during starting and accelerating.

A manufacturing method of a non-oriented electrical steel sheet according to an embodiment of the present invention includes: preparing a slab containing Si at 2.5 to 3.8 wt %, Al at 0.5 to 2.5 wt %, Mn at 0.2 to 4.5 wt %, C at 0.005 wt % or less (excluding 0 wt %), S at 0.005 wt % or less (excluding 0 wt %), N at 0.005 wt % or less (excluding 0 wt %), Nb at 0.004 wt % or less (excluding 0 wt %), Ti at 0.004 wt % or less (excluding 0 wt %), V at 0.004 wt % or less (excluding 0 wt %), Ta at 0.0005 to 0.0025 wt %, and the balance of Fe and inevitable impurities; heating the slab; hot-rolling the heated slab to manufacture a hot-rolled sheet; cold-rolling the hot-rolled sheet to manufacture a cold-rolled sheet; and final annealing the cold-rolled sheet to manufacture an electrical steel sheet.

Specifically, the slab may further include one or more of Cu at 0.025 wt % or less (excluding 0 wt %), B at 0.002 wt % or less (excluding 0 wt %), Mg at 0.005 wt % or less (excluding 0 wt %), and Zr at 0.005 wt % or less (excluding 0 wt %).

Specifically, the steel sheet may include one or more of a carbide-based precipitate, a nitride-based precipitate, and a sulfide-based precipitate having a diameter of 20 to 100 nm, and a distribution density of each of the carbide-based precipitate, the nitride-based precipitate, and the sulfide-based precipitate may be 0.9 pcs/$\mu m^2$ or less. More specifically, the distribution density is 0.5 pcs/$\mu m^2$ or less.

In addition, after the manufacturing of the hot-rolled sheet, hot-rolled-sheet-annealing the hot-rolled sheet may be further included.

Hereinafter, respective steps will be specifically described.

First, a slab satisfying the above-described composition is prepared. The reason for limiting the addition ratio of each composition in the slab is the same as the reason for limiting the composition of the non-oriented electrical steel sheet described above, so a repeated description will be omitted. Since the slab composition is not substantially changed during manufacturing processes including hot-rolling, hot-rolled sheet annealing, cold-rolling, and final annealing to be described later, the composition of the slab and the composition of the non-oriented electrical steel sheet are substantially the same.

Next, the prepared slab is heated. As it is heated, a subsequent hot-rolling process may be smoothly performed, and thus the slab may be uniformly processed. More specifically, the heating may mean reheating. In this case, a heating temperature of the slab may be 1100 to 1250° C. When the heating temperature of the slab is too high, the precipitates may be re-dissolved and finely precipitated after the hot-rolling.

Next, the hot-rolled steel sheet is manufactured by hot-rolling the heated slab. A finish rolling temperature of the hot-rolling may be 750° C. or higher.

After the manufacturing of the hot-rolled sheet, hot-rolled-sheet-annealing the hot-rolled sheet may be further included. In this case, a temperature of the hot-rolled-sheet-annealing may be 850 to 1150° C. When the temperature of the hot-rolled-sheet-annealing is too low, the structure does not grow or finely grows, so that the effect of increasing the magnetic flux density is small, and conversely, when the temperature of the hot-rolled-sheet-annealing is too high, magnetic characteristics are rather deteriorated, and rolling workability may be deteriorated due to deformation of a sheet shape. Specifically, the temperature of the hot-rolled-sheet-annealing may be 950 to 1125° C. More specifically, the temperature of the hot-rolled-sheet-annealing may be 900 to 1100° C. The hot-rolled-sheet-annealing is performed in order to increase the orientation favorable to magnetism as required, and it may be omitted.

Next, the hot-rolled sheet is pickled and then cold-rolled to have a predetermined sheet thickness, so that a cold-rolled sheet is manufactured. It may be differently applied depending on the thickness of the hot-rolled sheet, but it may be cold-rolled by applying a reduction ratio of 70 to 95% so that the final thickness may be 0.2 to 0.65 mm to manufacture a cold-rolled sheet. More specifically, the cold-rolled sheet may be manufactured by cold-rolling so that the final thickness becomes 0.1 to 0.3 mm.

Next, the cold-rolled sheet is finally annealed to manufacture an electrical steel sheet. The final annealing temperature may be 800 to 1050° C. When the final annealing temperature is very low, recrystallization may be insufficiently generated, and when the final annealing temperature is very high, the crystal grains rapidly grow, so the magnetic flux density and the high-frequency iron loss may be deteriorated. Specifically, it may be finally annealed at the temperature of 900 to 1000° C. In the final annealing process, the texture formed in the previous cold-rolling step may be entirely (that is, 99% or more) recrystallized.

Hereinafter, examples of the present invention will be described in more detail. However, it is necessary to note that the following examples are only intended to illustrate the present invention in more detail and are not intended to limit the scope of the present invention. This is because the scope of the present invention is determined by constituent elements described in the claims and reasonably inferred therefrom.

EXAMPLES

A steel ingot was prepared with the elements shown in Table 1 by vacuum-melting in a laboratory. This was reheated at 1150° C. and hot-rolled at a finishing temperature of 780° C. to manufacture a hot-rolled sheet with a thickness of 2.0 mm. The hot-rolled hot-rolled sheet was annealed at 1030° C. for 100 seconds, and then pickled and cold-rolled to become thicknesses of 0.15, 0.25, 0.27, and 0.30 mm, and then recrystallization-annealed at 1000° C. for 110 seconds.

For each specimen, distribution densities of carbide, nitride, and sulfide; $W_{15/50}$ iron loss and $W_{10/400}$ iron loss; hysteresis loss ($W_h15/50$) of $W_{15/50}$ and hysteresis loss ($W_h10/400$) of $W_{10/400}$; and $B_{50}$ magnetic flux density are shown in Table 2. Here, the carbide, nitride, and sulfide all mean precipitates with a diameter of 20 to 100 nm. Regarding the magnetic characteristics such as the magnetic flux density or the iron loss, for each specimen, the specimen of 60 mm (width)×60 mm (length)×5 (number of pieces) was incised and was measured in the rolling direction and the vertical rolling direction with a single sheet tester to find an average value. In this instance, $W_{10/400}$ represents an iron loss when the magnetic flux density of 1.0 T is induced at the frequency of 400 Hz, $W_{10/50}$ indicates an iron loss when the magnetic flux density of 1.0 T is induced at the frequency of 50 Hz, and $B_{50}$ is the magnetic flux density induced in the magnetic field of 5000 Nm.

Regarding $W_h15/50$ and $W_h10/400$, for each specimen, the specimen of 60 mm (width)×60 mm (length)×5 (number of pieces) was incised and was measured in mJ/kg unit at 1.5 T and 1.0 T with a DC magnetic meter, and then a result was obtained by multiplying frequencies of 50 Hz and 400 Hz thereto, respectively, and averaging the five measured values. In this case, a measurement speed of 50 mT/s was applied.

TABLE 1

| Specimen number | Si (%) | Al (%) | Mn (%) | C (ppm) | S (ppm) | N (ppm) | Nb (ppm) | Ti (ppm) | V (ppm) | Ta (ppm) |
|---|---|---|---|---|---|---|---|---|---|---|
| A1 | 3.0 | 2.0 | 1.0 | 57 | 10 | 34 | 11 | 29 | 15 | 14 |
| A2 | 3.0 | 2.0 | 1.0 | 71 | 25 | 28 | 13 | 28 | 21 | 17 |
| A3 | 3.0 | 2.0 | 1.0 | 31 | 31 | 29 | 10 | 32 | 18 | 12 |
| A4 | 3.0 | 2.0 | 1.0 | 44 | 29 | 11 | 9 | 26 | 19 | 18 |
| B1 | 3.2 | 1.2 | 1.5 | 27 | 60 | 14 | 21 | 11 | 32 | 7 |
| B2 | 3.2 | 1.2 | 1.5 | 34 | 75 | 10 | 18 | 13 | 27 | 15 |
| B3 | 3.2 | 1.2 | 1.5 | 36 | 11 | 11 | 17 | 10 | 33 | 18 |
| B4 | 3.2 | 1.2 | 1.5 | 31 | 38 | 16 | 18 | 8 | 26 | 8 |
| C1 | 3.2 | 1.0 | 2.0 | 41 | 41 | 82 | 28 | 25 | 9 | 21 |
| C2 | 3.2 | 1.0 | 2.0 | 27 | 22 | 59 | 30 | 21 | 14 | 20 |
| C3 | 3.2 | 1.0 | 2.0 | 26 | 36 | 21 | 29 | 28 | 14 | 21 |
| C4 | 3.2 | 1.0 | 2.0 | 43 | 38 | 38 | 27 | 24 | 12 | 17 |
| D1 | 3.4 | 0.7 | 1.1 | 36 | 26 | 36 | 48 | 15 | 21 | 18 |
| D2 | 3.4 | 0.7 | 1.1 | 21 | 14 | 27 | 17 | 51 | 17 | 15 |
| D3 | 3.4 | 0.7 | 1.1 | 37 | 37 | 32 | 19 | 20 | 15 | 18 |
| D4 | 3.4 | 0.7 | 1.1 | 39 | 43 | 31 | 22 | 23 | 17 | 11 |
| E1 | 3.6 | 1.5 | 0.7 | 29 | 8 | 37 | 19 | 25 | 45 | 20 |
| E2 | 3.6 | 1.5 | 0.7 | 40 | 31 | 26 | 18 | 29 | 19 | 39 |
| E3 | 3.6 | 1.5 | 0.7 | 36 | 22 | 21 | 12 | 21 | 15 | 13 |
| E4 | 3.6 | 1.5 | 0.7 | 33 | 31 | 29 | 15 | 26 | 18 | 15 |

TABLE 2

| Specimen number | Thickness [mm] | Carbide distribution density [pcs/mm$^2$] | Nitride distribution density [pcs/mm$^2$] | Sulfide distribution density [pcs/mm$^2$] | W15/50 [W/kg] | W10/400 [W/kg] | $W_h15/50$ [W/kg] | $W_h10/400$ [W/kg] | B50 [T] | Remarks |
|---|---|---|---|---|---|---|---|---|---|---|
| A1 | 0.15 | 2.42 | 0.41 | 0.37 | 1.95 | 9.94 | 1.32 | 4.16 | 1.62 | Comparative example |
| A2 | | 3.58 | 0.37 | 0.45 | 1.97 | 10.01 | 1.35 | 4.18 | 1.62 | Comparative example |
| A3 | | 0.34 | 0.36 | 0.42 | 1.66 | 8.54 | 0.98 | 3.78 | 1.65 | Inventive example |
| A4 | | 0.38 | 0.44 | 0.39 | 1.67 | 8.48 | 0.97 | 3.77 | 1.65 | Inventive example |
| B1 | 0.25 | 0.41 | 0.41 | 2.75 | 2.03 | 12.43 | 1.35 | 4.16 | 1.63 | Comparative example |
| B2 | | 0.37 | 0.37 | 2.81 | 2.04 | 12.37 | 1.38 | 4.17 | 1.63 | Comparative example |
| B3 | | 0.35 | 0.43 | 0.35 | 1.77 | 10.57 | 0.97 | 3.75 | 1.67 | Inventive example |
| B4 | | 0.42 | 0.37 | 0.36 | 1.78 | 10.63 | 0.96 | 3.74 | 1.67 | Inventive example |
| C1 | | 0.39 | 4.21 | 0.39 | 2.04 | 12.29 | 1.34 | 4.11 | 1.63 | Comparative example |
| C2 | | 0.31 | 3.98 | 0.35 | 2.02 | 12.45 | 1.33 | 4.13 | 1.63 | Comparative example |
| C3 | | 0.32 | 0.35 | 0.42 | 1.76 | 10.61 | 0.95 | 3.75 | 1.67 | Inventive example |
| C4 | | 0.37 | 0.32 | 0.37 | 1.76 | 10.59 | 0.95 | 3.71 | 1.67 | Inventive example |
| D1 | 0.27 | 2.15 | 0.42 | 0.43 | 2.04 | 13.34 | 1.33 | 4.18 | 1.63 | Comparative example |
| D2 | | 2.31 | 0.45 | 0.45 | 2.06 | 13.41 | 1.38 | 4.16 | 1.63 | Comparative example |
| D3 | | 0.37 | 0.38 | 0.41 | 1.79 | 11.76 | 0.96 | 3.72 | 1.67 | Inventive example |
| D4 | | 0.35 | 0.43 | 0.39 | 1.80 | 11.67 | 0.97 | 3.74 | 1.67 | Inventive example |
| E1 | 0.30 | 2.65 | 0.38 | 0.43 | 2.07 | 14.23 | 1.36 | 4.13 | 1.64 | Comparative example |
| E2 | | 1.01 | 0.44 | 0.31 | 2.05 | 14.31 | 1.35 | 4.12 | 1.64 | Comparative example |
| E3 | | 0.39 | 0.42 | 0.34 | 1.82 | 12.57 | 0.97 | 3.72 | 1.68 | Inventive example |
| E4 | | 0.41 | 0.39 | 0.36 | 1.82 | 12.63 | 0.96 | 3.71 | 1.68 | Inventive example |

As shown in Table 1 and Table 2, regarding A3, A4, B3, B4, C3, C4, D3, D4, E3, and E4 in which alloy components were appropriately controlled, the distribution densities of carbides, nitrides, and sulfides having a diameter of 20 to 100 nm were excellent at 0.9 pcs/μm$^2$ or less, and thus all of them had excellent magnetic characteristics. On the other hand, A1 and A2 had a large amount of C, so that the distribution density of carbides having a size that was not good for magnetism increased, so the iron loss was poor and the magnetic flux density was deteriorated due to the increase in hysteresis loss. B1 and B2 had a S content exceeding the scope of the present invention, and C1 and C2 had a N content exceeding the scope of the present invention, so that the distribution densities of sulfides and nitrides having a size that was not good for magnetism increased, thus the iron loss and magnetic flux density were deteriorated. D1, D2, and E1 respectively had Nb, Ti, and V exceeding the scope of the present invention, so that the distribution densities of sulfides and nitrides having a size that was not good for magnetism exceeded 0.9 pcs/μm$^2$ and thus increased, so the iron loss and magnetic flux density were deteriorated. E2 had a Ta content exceeding the scope of the present invention, so that the distribution density of carbides having a size that was not good for magnetism increased, thus the iron loss and magnetic flux density were deteriorated.

The present invention may be embodied in many different forms, and should not be construed as being limited to the disclosed embodiments. In addition, it will be understood by those skilled in the art that various changes in form and details may be made thereto without departing from the technical spirit and essential features of the present invention. Therefore, it is to be understood that the above-described embodiments are for illustrative purposes only, and the scope of the present invention is not limited thereto.

The invention claimed is:

1. A non-oriented electrical steel sheet, comprising Si at 2.5 to 3.8 wt %, Al at 0.7 to 2.0 wt %, Mn at 0.2 to 4.5 wt %, C at 0.005 wt % or less (excluding 0 wt %), S at 0.005 wt % or less (excluding 0 wt %), N at 0.005 wt % or less (excluding 0 wt %), Nb at 0.004% or less (excluding 0 wt %), Ti at 0.004% or less (excluding 0 wt %), V at 0.004% or less (excluding 0 wt %), Ta at 0.0005 to 0.0025 wt %, and the balance of Fe and inevitable impurities, wherein the steel sheet contains one or more of a carbide-based precipitate, a nitride-based precipitate, and a sulfide-based precipitate with a diameter of 20 to 100 nm, and a distribution density of each of the carbide-based precipitate, the nitride-based precipitate, and the sulfide-based precipitate is 0.9 pcs/$\mu m^2$ or less.

2. The non-oriented electrical steel sheet of claim 1, further comprising one or more of Cu at 0.025 wt % or less (excluding 0 wt %), B at 0.002 wt % or less (excluding 0 wt %), Mg at 0.005 wt % or less (excluding 0 wt %), and Zr at 0.005 wt % or less (excluding 0 wt %).

3. The non-oriented electrical steel sheet of claim 1, wherein a thickness of the steel sheet is 0.1 to 0.3 mm.

4. The non-oriented electrical steel sheet of claim 1, wherein an average grain diameter is 40 to 100 μm.

5. The non-oriented electrical steel sheet of claim 1, wherein a hysteresis loss in $W_{10/400}$ iron loss is 1.0 W/kg or less, and a hysteresis loss in $W_{10/400}$ iron loss is 3.8 W/kg or less.

* * * * *